United States Patent [19]

Launder

[11] Patent Number: 4,516,340

[45] Date of Patent: May 14, 1985

[54] ATTACHMENT ASSEMBLY FOR EXCAVATION TEETH

[76] Inventor: Richard L. Launder, 8107 San Lucas Dr., Whittier, Calif. 90605

[21] Appl. No.: 501,520

[22] Filed: Jun. 6, 1983

[51] Int. Cl.[3] ..... E02F 9/28

[52] U.S. Cl. ..... 37/142 A; 172/713; 172/777; 403/334; 403/379

[58] Field of Search ..... 37/141 R, 141 T, 142 R, 37/142 A; 172/762, 699, 713, 777; 403/333, 334, 318, 379

[56] References Cited

U.S. PATENT DOCUMENTS

| | | | |
|---|---|---|---|
| 3,677,187 | 7/1972 | Stewart | 403/334 X |
| 3,919,792 | 11/1975 | Hahn et al. | 403/333 X |
| 4,077,729 | 3/1978 | Schwappach | 37/142 A X |
| 4,231,173 | 11/1980 | Davis | 37/142 R |
| 4,233,761 | 11/1980 | Ryerson | 37/142 R |
| 4,335,532 | 6/1982 | Hahn et al. | 37/142 R |
| 4,338,736 | 7/1982 | Radigan | 37/142 A |

*Primary Examiner*—Edgar S. Burr
*Assistant Examiner*—Moshe I. Cohen
*Attorney, Agent, or Firm*—Lyon & Lyon

[57] ABSTRACT

An attachment assembly for securing an excavation tooth in a row of closely spaced teeth on large earth excavating equipment. The assembly includes a nose piece, an excavation tooth and a securement pin. The nose piece has a base portion which is secured in a conventional manner to the shovel or dipper bucket of the excavation equipment, and a tapered extension for carrying the tooth. The tapered extension of the nose piece defines a recessed flat horizontal surface at the extended end thereof inwardly spaced from the lateral sides of the nose piece to define a horizontal stabilizing surface bordered by a vertical stabilizing wall. The tooth has a channel therein corresponding in configuration to the tapered extension of the nose piece so that the nose piece can fit thereover in a mating relationship. The securement pin which is comprised of two elongate members joined by a hard, resilient rubber center, extends vertically through the tapered extension of the nose piece and the excavation tooth to secure the tooth on the nose pin. The mating relationship of the channel walls in the tooth with the vertical stabilizing wall and recessed horizontal stabilizing surface on the nose piece provides both lateral and vertical stability for the tooth without the need for additional horizontal locking pins.

1 Claim, 4 Drawing Figures

ATTACHMENT ASSEMBLY FOR EXCAVATION TEETH

BACKGROUND OF THE INVENTION

This invention relates generally to an assembly for the connection of large excavation teeth to the shovel or dipper bucket of large excavation equipment. More particularly, this invention relates to an assembly for securing a large excavation tooth which utilizes a single flex pin to connect the tooth to the excavating equipment on which the excavation teeth are closely spaced.

During the course of large ground excavation projects, it has been found that it is preferable to make the excavation teeth a separate and distinct part, readily attachable and detachable to the main excavation implement, rather than forming the excavation teeth integrally with the main implement. This allows for easy replacement of individual teeth should a tooth become broken or dull.

Traditionally, the excavation tooth has a hollow interior portion which fits onto a nose piece which is integrally formed with the main implement. Pin means are thrust through an orifice in the excavation tooth and through a channel in the nose piece to retain the tooth in position on the nose piece. Because of the tremendous pressure which is exerted upon the tooth during excavation, it is desirable to displace the pin transversely to the excavation movement, which is normally and primarily in the vertical direction. Parallel placement of the pin allows the pin to wobble under the force generated by the excavation implement. This wobble causes early failure of the pin causing the tooth to drop off.

Until fairly recently, a simple arrangement involving a single horizontally displaced pin was sufficient. Now, however, the excavation implements are utilizing closely spaced teeth, thereby making it difficult, and in some instances impossible, to displace the traditional horizontal pin within the excavation tooth. Therefore, there existed a need in the art for a locking assembly whereby the excavation tooth may be engaged and disengaged by working vertically.

Another problem has been encountered with devices of this type which stems from the fact that the nose piece of the implement can become worn so that there is not a precise fit between the tooth and the nose piece. This allows for some horizontal movement of the tooth on the nose piece as well as some vertical or rotational movement of the tooth with respect to the nose piece. A solution to these problems is found in applicant's copending application, Ser. No. 200,396 filed Oct. 24, 1980, and entitled "Method and Device for Attaching Excavation Teeth," now abandoned and refiled on Nov. 1, 1982, as continuation-in-part application Ser. No. 438,512, now abandoned. Therein applicant developed a three-pin assembly which successfully held the tooth on the nose pin in a snug fit providing both horizontal and vertical stability while facilitating removal of a single excavation tooth in a group of closely aligned teeth. However, the assembly disclosed therein requires the implementation of both a vertical and horizontal channel extending through the tooth and the nose piece. When utilizing such an assembly on the larger shovels and buckets wherein each tooth weighs approximately 145 lbs., the manufacture of the teeth with the perpendicularly disposed channels extending therethrough becomes a difficult and expensive process. It was therefore deemed highly desirable to develop an assembly for such larger teeth which provided the same securement and replacement features found in the three-pin assembly, but which obviated the need for two transverse channels extending through the teeth and tapered portions of the nose piece. The single pin assembly disclosed herein accomplishes that objective.

SUMMARY OF THE INVENTION

Briefly, the present invention is directed to an assembly for securing large excavating teeth on large earth excavation equipment in a manner such that the teeth which are closely spaced can be readily removed for replacement and, during use, are resistant to lateral and vertical or pivotal movement with respect to the nose piece on which they are mounted. The assembly includes a nose piece, an excavation tooth and a single securement pin. The nose piece has a base portion which is secured to the excavation equipment in a conventional manner and a tapered extension for carrying the excavation tooth. The tapered extension defines a recessed horizontal stabilizing surface at the extended end thereof which is bordered by a vertical stabilizing wall. The tooth has a channel therein corresponding to the configuration of the tapered extension of nose piece so that the nose piece can fit snugly thereover in a mating relationship, and the securement pin extends vertically through the tapered extension of the nose piece and the excavation tooth securing the tooth in place on the nose piece. The mating relationship of the channel walls in the excavation tooth with the recessed horizontal stabilizing surface and vertical stabilizing walls prevents lateral and vertical, or rotational movement of the tooth with respect to the nose piece to provide a secured and durable yet readily detachable excavation tooth assembly.

It is therefore the principal object of the present invention to provide an attachment assembly for securing a large excavation tooth in a row of closely spaced teeth on large excavation equipment wherein only a single vertical pin is needed for securement of the tooth on the supporting nose piece.

It is another object of the present invention to provide an improved attachment assembly for securing a large excavation tooth in a row of closely spaced teeth on large earth excavating equipment which is of relatively simple construction and economical to manufacture.

These and other objects and advantages of the present invention will become apparent from the following detailed description taken in conjunction with the accompanying drawings.

DESCRIPTION OF THE PREFERRED EMBODIMENT

Figure 1:
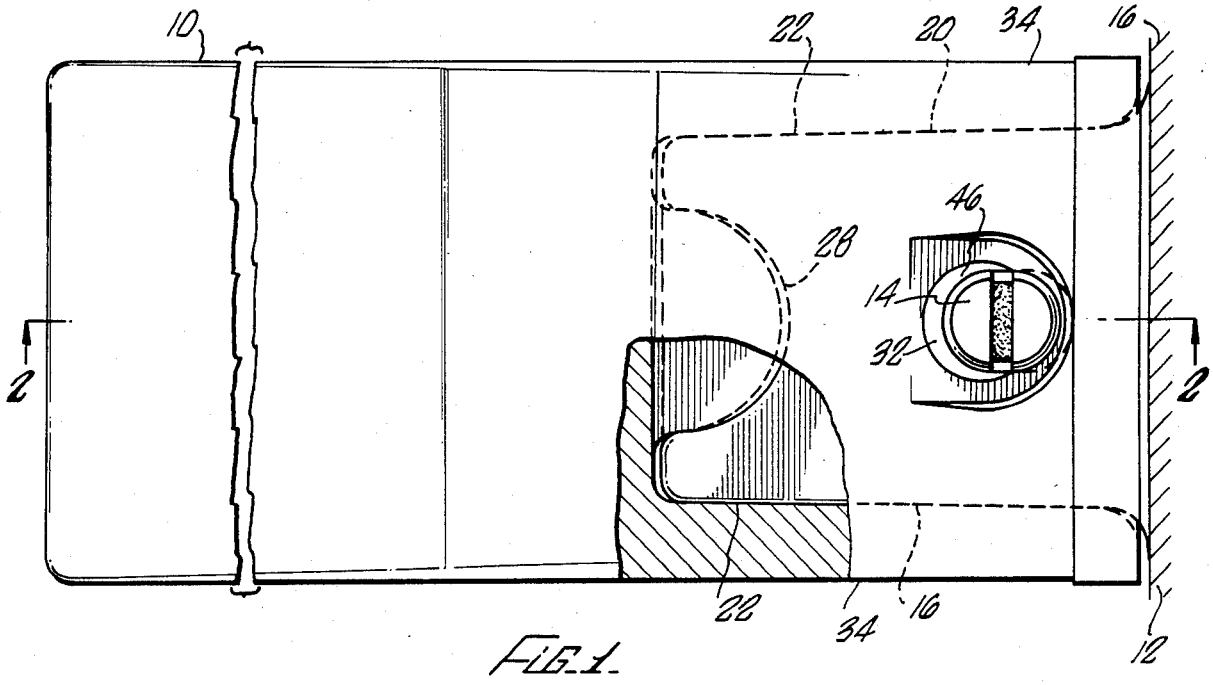
FIG. 1 is a top view of the tooth, tapered portion of the nose piece and securement pin of the present invention.
Figure 2:
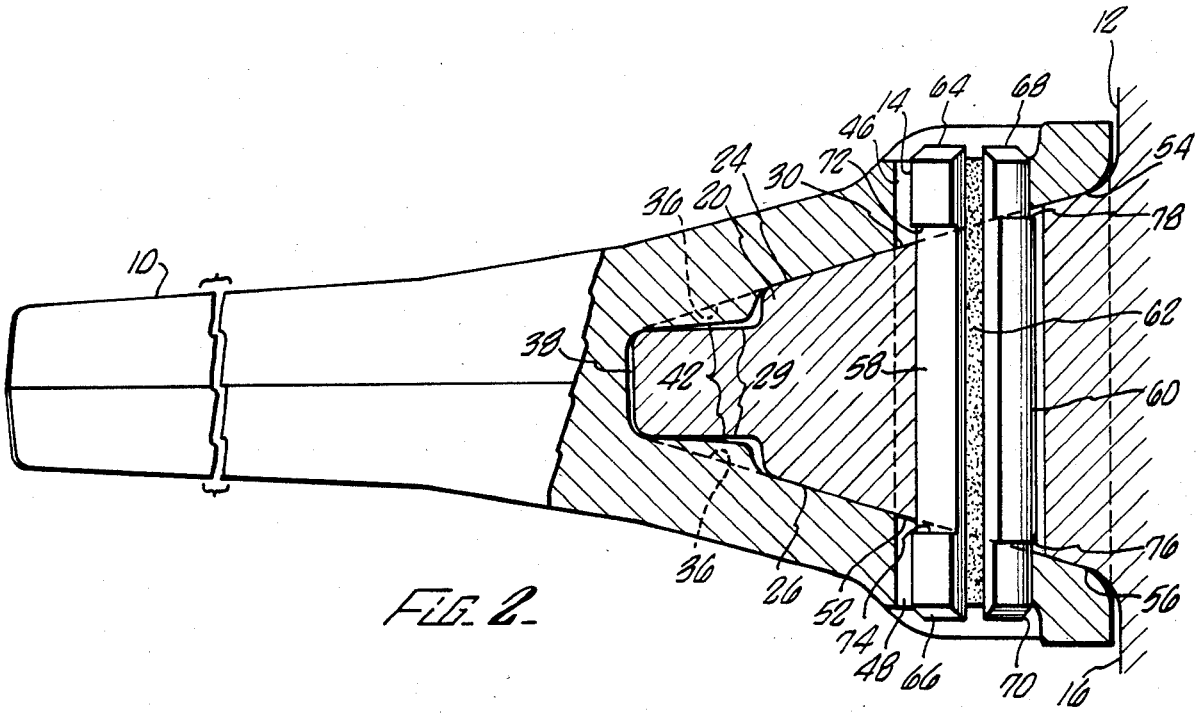
FIG. 2 is a sectional view taken along line 2—2 in FIG. 1.
Figure 3:
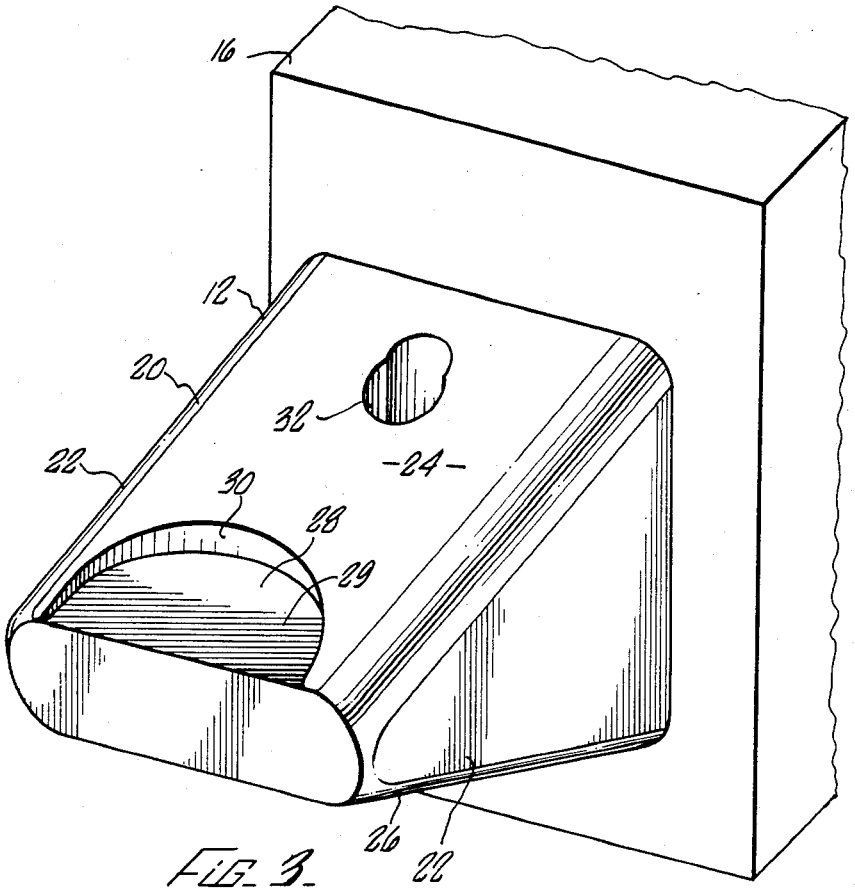
FIG. 3 is a perspective view of the tapered extension of the nose piece illustrating the vertical and horizontal tooth securement surfaces thereon.
Figure 4:
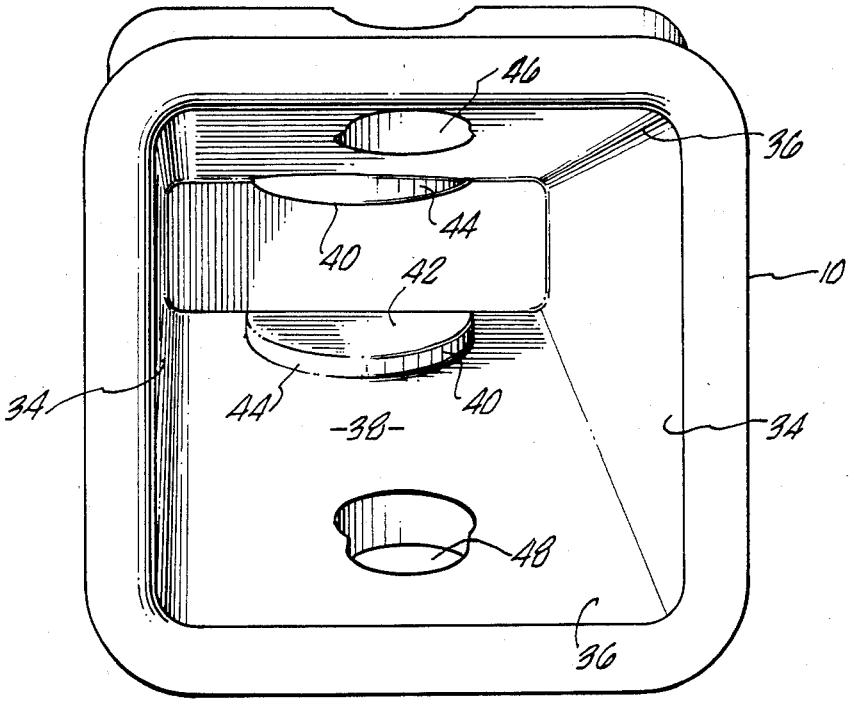
FIG. 4 is a perspective view of the tooth illustrating the interior thereof.

The assembly of the present invention is comprised of a tooth 10, nose piece 12 and securement flex pin 14. The nose piece 12 has a conventional base portion 16 which is adapted for conventional securement by a wedge locking mechanism to the shovel or dipper bucket of the earth excavation device (not shown). Integrally formed with and extending forwardly of the base portion 16 of the nose piece 12 is a tapered extension 20 which carries the tooth 10 as seen in FIGS. 1 and 2. The tapered extension 20 has a pair of tapered lateral side walls 22 and tapered upper and lower surfaces 24 and 26. Surfaces 24 and 26 have recessed areas 28 cut therein at the extended ends thereof which define flat substantially horizontal stablizing surfaces 29 bordered by curvilinear vertical stablizing walls 30. Surfaces 29 are not truly horizontal, but tapered slightly to facilitate removal of the nose piece from the dye during fabrication. Accordingly, the surfaces 29 are referred to herein as substantially horizontal and are therefore substantially, but not exactly, parallel to one another. The terms horizontal and vertical as used herein refer to the orientation of the excavating implement upon the ground. The excavation movement of the implement would be primarily in the vertical direction. A substantially elliptical vertical channel 32 extends through the rearward portion of the tapered extension 20 thereof for receipt of the securement flex pin 14 in a manner to be described. This channel can be formed by drilling two overlapping holes through the rear portion of extension 20 to provide the configuration illustrated in the drawings.

Tooth 10 has substantially parallel side walls 34, tapered upper and lower surfaces 36 and defines a cavity 38 therein which corresponds in configuration to the tapered extension 20 of the nose piece so that the tooth 10 can fit snugly thereover in a mating relationship. Protuberances 40 which are integrally formed with the tooth extend into the cavity 38 from surfaces 36 such that the inwardly projecting horizontal surfaces 42 thereof mate in an abutting relationship with the flat stablizing surface 29 in the end of the nose piece 12 and the outer perimeter walls 44 of protuberances 40 abuts the vertical stablizing walls 30. As shown in the drawings, areas 28 and mating protuberances 40 are substantially semicircular to facilitate manufacture of the stablizing surfaces 29 and walls 30 by drilling the areas 28 out of the forged steel tooth. If desired, other shapes could also be employed albeit at a greater cost of manufacture. If other configurations of the stabilizing surfaces were employed the protuberances would be shaped correspondingly to mate with the horizontal and vertical stabilizing surfaces defining the recessed area as above described.

Tooth 10 has elliptically-shaped orifices 46 and 48 extending through the rearward portion thereof bifurcated by cavity 38 and corresponding to the channel 32 in the nose piece 12. The major diameters of orifices 46 and 48 are slightly larger than the major diameter of elliptical channel 32 as seen in FIGS. 1 and 2 so as to substantially, but not totally register with vertical channel 32 when the tooth 10 is secured on the nose piece 12 such that a portion of the nose piece is exposed in orifices 46 and 48 to create shoulders 50 and 52 and a portion of the tooth 10 extends over channel 32 to create shoulders 54 and 56 (see FIG. 2).

The securement flex pin 14 is ellipsoidal in cross section having a first half or elongate member 58 and a second half or elongate member 60 joined in a conventional manner by a hard yet resilient rubber center 62. The width of flex pin 14 across the rubber center 62 is slightly larger than the corresponding dimension of channel 32 such that upon insertion of the flex pin 14 in channel 32 a degree of compression of rubber center 62 occurs. The elongate members 58 and 60 are preferably constructed of heat-treated alloy steel. The hard rubber center 62 is preferably constructed of 60 shore hard rubber. First elongate member 58 has a heel portion 64 and a beveled nose portion 66. The heel portion 64 presents a blunt surface to the hammer or other implement (not shown) used to drive the flex pin 14 through orifice 46 or 48 and into the vertical channel 32 in the nose piece. The second elongate member 60 of flex pin 14 has a heel portion 68 and a beveled nose portion 70.

The exterior diameter of first elongate member 58 is abruptly reduced below heel portion 64 and above nose portion 66 to create shoulders 72 and 74. The exterior diameter of the second elongate member 60 is abruptly increased below heel portion 68 and above nose portion 70 to create shoulders 76 and 78. The distance between shoulders 72 and 74 correspond to the minor diameter of vertical channel 32 at its point nearest the working end of tooth 10. This is best seen in FIG. 2. Therefore, when flex pin 14 is inserted through orifice 48 into vertical channel 32, the shoulders 72 and 74 will embrace nose piece 12 at either end of channel 32 thereby retaining flex pin 14 within the nose piece 12. Similarly, the distance between shoulders 76 and 78 corresponds to the distance between the interior edges of orifices 46 and 48 at a point most distant from the working end of tooth 10. This is also best seen in FIG. 2. Accordingly, when flex pin 14 is fully inserted into nose piece 12, shoulders 76 and 78 will abut against tooth 10 at the interior edge of orifices 46 and 48. This will also work to retain flex pin 14 within nose piece 12.

To attach the tooth 10 to the nose piece 12 it is only necessary to place the tooth over the tapered extension 20 of the nose piece such that orifices 46 and 48 register with the vertical channel 32 in the nose piece. Flex pin 14 is then inserted, nose portion 66 and 71, with the flex pin oriented such that first elongate member 58 is pointed toward the working end of tooth 10. Flex pin 14 is then forced into vertical channel 32. When the flex pin 14 is fully inserted into channel 32, as shown in FIG. 2, shoulder 72 engages the nose piece 12 at shoulder 50, limiting further insertion. At this point, shoulder 78 of the second elongate member 60 moves past tooth 10, allowing the rubber center 62 to expand, thereby forcing shoulder 78 outward such that it would abut tooth 10 at shoulder 54 if withdrawal of the flex pin 14 were attempted. A similar result occurs with shoulders 74, 76, 52 and 56. The flex pin 14 is thusly retained in channel 32.

The abutting relationship of the vertical stabilizing wall 30 on the nose piece surrounding recessed area 28 with the perimeter wall 44 of the protuberance 40 on the interior of tooth 10 extending into recessed area 28 prevents lateral movement of the tooth with respect to the nose piece during use which would otherwise cause undesirable wear on the respective parts. Similarly, the abutting relationship of the horizontal lower surface 44 of the protuberance 40 on the tooth 10 with the flat horizontal stabilizing surface 29 on the nose piece prevents vertical rotational movement of the tooth with respect to the nose piece which would also result in wear and is heretofore required the use of additional horizontal locking pins.

Various changes and modifications may be made in carrying out the present invention without departing from the spirit and scope thereof. Insofar as these changes and modifications are within the purview of the appended claims they are to be considered as part of the present invention.

I claim:

1. An assembly for securing an excavation tooth in a row of teeth on an earth excavation implement comprising: a nose piece adapted to be secured to the excavation implement and defining a base portion, a forwardly extending tapered portion, said tapered portion having parallel lateral side walls and converging upper and lower surfaces, said side walls and said surfaces terminating in a forward end, a channel extending vertically through said tapered portion, a pair of substantially semi-circular recessed areas disposed in said upper and lower surfaces adjacent said forward end, said areas defining a pair of substantially parallel stablizing surfaces and curvilinear wall surfaces, said wall surfaces being perpendicarly disposed with respect to said stablizing surfaces and extending between said stablizing surfaces and said converging upper and lower surfaces and terminating at said forward end, the diameter of said recessed areas being less than the spacing between said lateral side walls; and excavation tooth having a hollow portion adapted to be snugly slidable onto said tapered portion of said nose piece and including a pair of protuberances extending into said hollow portion, said protuberances defining abutment surfaces adapted to abut in a mating relationship with said stablizing surfaces on said nose piece and perimeter wall portions extending about portions of said abutment surfaces and adapted to abut in a mating relationship said wall surfaces on said nose piece and a channel extending vertically through said tooth and communicating with said hollow portion thereof; and pin means adapted to extend through said channels in said nose piece and said excavation tooth for holding said tooth on said nose piece.

* * * * *